United States Patent [19]

Murchison

[11] Patent Number: 4,831,905

[45] Date of Patent: May 23, 1989

[54] SPRING ACTUATED SPREAD CLAMP

[75] Inventor: Fred S. Murchison, Pearsall, Tex.

[73] Assignee: Joe C. Martin, III, Laredo, Tex.

[21] Appl. No.: 249,657

[22] Filed: Sep. 27, 1988

[51] Int. Cl.[4] ..... B25B 5/04

[52] U.S. Cl. ..... 81/485; 81/302; 294/97; 29/239; 269/254 CS

[58] Field of Search ..... 81/485, 488, 302, 427, 81/417, 300, 424, 352; 29/239; 269/157, 166, 161, 254 CS, 42, 43, 37; 254/8 B, 50.1; 294/97, 99.2

[56] References Cited

U.S. PATENT DOCUMENTS 1,931,498 10/1933 Kattrein ..... 81/3.02
2,815,777 12/1957 Iraids ..... 81/427
3,263,535 8/1966 Zurcher ..... 81/302
4,197,706 4/1980 Blake ..... 29/239

*Primary Examiner*—Roscoe V. Parker
*Attorney, Agent, or Firm*—Cox & Smith Incorporated

[57] ABSTRACT

A spring actuated clamping device is disclosed for woodworking applications and the like. The device is applicable to those situations where it is desired to exert clamping forces in opposite directions against two surfaces facing one another. The device comprises two arms which are pivotally attached to each other. The distal ends of the arms are urged to pivot outwardly by a spring. Pivotable pads at the distal end of each arm provide a flat contacting surface regardless to the extent the arms are pivoted.

5 Claims, 1 Drawing Sheet

SPRING ACTUATED SPREAD CLAMP

BACKGROUND AND INVENTION SUMMARY

The present invention relates to spring actuated clamping devices. These devices are particularly useful in woodworking applications where it is desired to join two workpieces together. The workpieces are first brought to the position in which they are to be glued or otherwise fastened together. The clamping device is then applied to the workpieces in a manner which maintains the joined position until the glue dries or other fastening means are applied.

In U.S. Pat. No. 2,815,777, there is disclosed a spring actuated clamping device utilizing pivotable jaws for engaging the workpieces. The pivotable jaws enable the device to clamp together panels at varying angles. When the device is applied, the pivoting jaws conform themselves to the angulation of the workpieces being clamped so as to present a flat engaging surface to each workpiece.

The device disclosed in the '777 patent is only useful, however, in those situations where the joined position of the workpieces can be maintained by applying inwardly directed clamping forces from opposite sides of the two workpieces. In certain applications, it is desirable to apply oppositely directed clamping forces in an outward direction from between two inner surfaces of a workpiece in order to join workpieces to the inner surfaces. For example, when paneling is mounted inside a drawer or other box-like structure in order to line the inside, it would be desirable to apply such outwardly directed clamping forces between opposite or adjacent sides of the drawer. The clamping forces would then maintain the paneling in a position flat against the inside surfaces of the drawer until the glue dries or other fastening is accomplished. It is accordingly a principal object of the present invention to provide a spring-actuated clamping device for producing such clamping forces as described.

The present invention basically comprises two arms which are pivotally connected at their proximal ends. A coil spring having two extensions for engaging the arms is mounted therebetween so as to urge the arms to pivot outwardly. Pivotally mounted on the distal ends of both arms are pads facing outwardly for engaging the surfaces of the workpieces to be clamped as the arms are urged outwardly by the spring.

DETAILED DESCRIPTION OF THE PREFERRED EMBODIMENT

Figure 3:
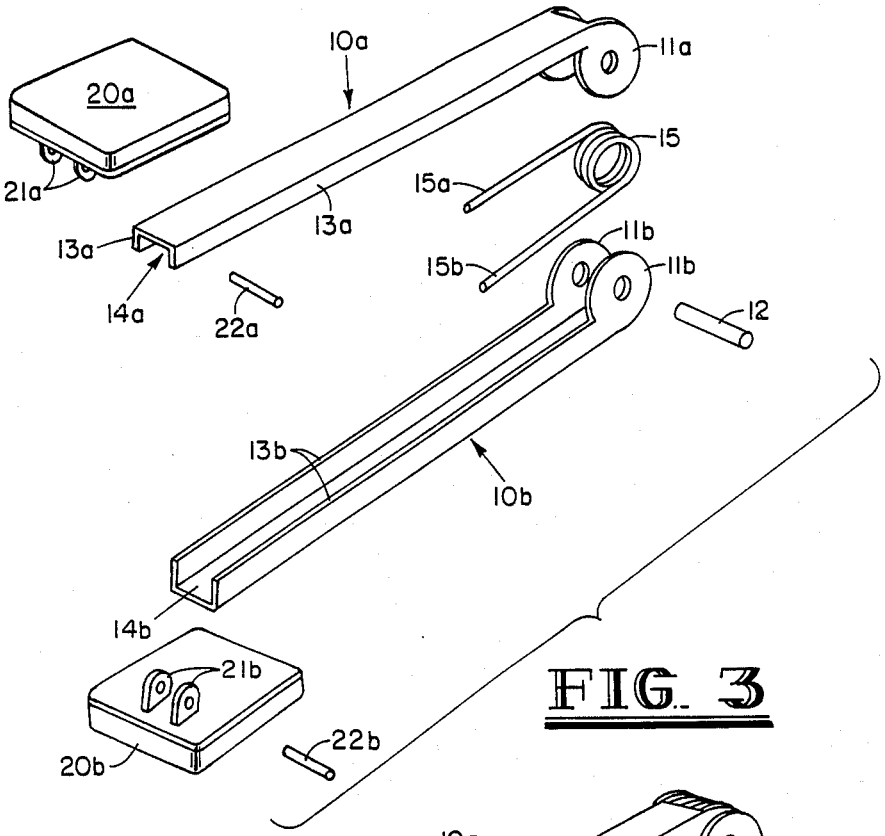
FIG. 3 is an exploded view of the device shown in FIG. 1.
Figure 1:
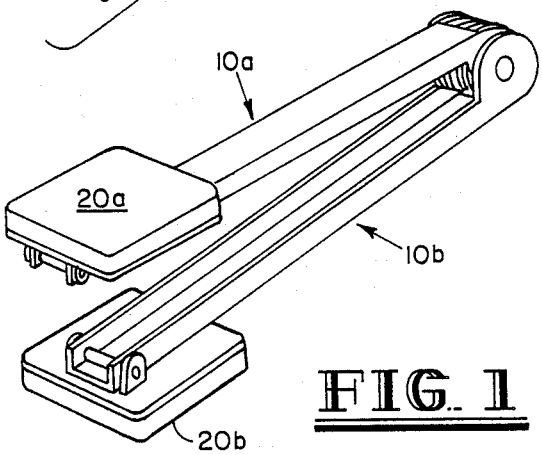
FIG. 1 is a perspective view of a clamping device constructed in accordance with the present invention.
Figure 2:
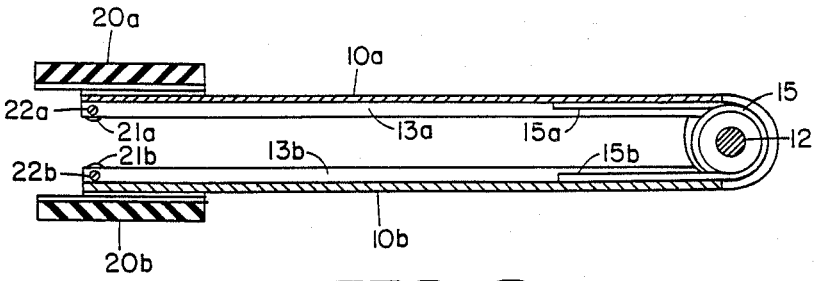
FIG. 2 is a cross-section of the device shown in FIG. 1 along the line labeled 2—2.

As shown iN FIGS. 1–3, a clamping device constructed in accordance with the present invention comprises a pair of arms 10*a* and 10*b* pivotally connected at their proximal ends. At the proximal end of arm 10*a* is a pair of circular tabs 11*a* extending from each side of the arm 10*a*. A similar pair of tabs 11*b* extend from the arm 10*b*. Tabs 11*b* are spaced slightly more apart than are tabs 11*a* thereby enabling both tabs 11*a* to fit between tabs 11*b*. Fitted between tabs 11*a* is a coil spring 15. When tabs 11*a* are fitted between tabs 11*b*, holes in each of the tabs are aligned, thereby allowing the insertion of a pin 12 which pivotally secures the proximal ends of arms 10*a* and 10*b* together. Additionally, the pin 12 inserts through the center of spring 15 which secures spring 15 between tabs 11*a*.

Coextensive with the circular tabs 11*a* and 11*b* on each arm are a pair of sidewalls 13*a* and 13*b*, respectively, which define longitudinal slots 14*a* and 14*b* along the inner surfaces of both of arms 10*a* and 10*b*. Extensions 15*a* and 15*b* of coil spring 15 fit within slots 14*a* and 14*b*, respectively. Slots 14*a* and 14*b* secure spring extensions 15*a* and 15*b* within arms 10*a* and 10*b*. Spring 15 is biased such that the extensions 15*a* and 15*b* urge arms 10*a* and 10*b* to pivot outwardly.

At the distal ends of arms 10*a* and 10*b* are a pair of aligned holes through sidewalls 13*a* and 13*b*. Pads 20*a* and 20*b* are pivotally mounted on the distal ends of arms 10*a* and 10*b*, respectively, by means of tabs 21*a* and 21*b*. Tabs 21*a* and 21*b* are spaced slightly farther apart than are sidewalls 13*a* and 13*b* and also have aligned holes therethrough. When arms 10*a* and 10*b* are fitted between the tabs 21*a* and 21*b*, pins 22*a* and 22*b* are inserted through the aligned holes to pivotally secure both pads. Pads 20*a* and 20*b* can thereby present flat engaging surfaces against the workpiece surfaces against which clamping forces are to be applied regardless of the degree of angulation between the workpiece surfaces or the extent to which arms 10*a* and 10*b* are pivoted.

Although the invention has been described in conjunction with the foregoing specific embodiment, many alternatives, variations and modifications are apparent to those of ordinary skill in the art. Those alternatives, variations and modifications are intended to fall within the spirit and scope of the appended claims.

What is claimed is:

1. A spring actuated clamping device, comprising:

a pair of arms pivotally connected at their proximal ends;

a coil spring for urging said pair of arms to pivot outwardly; and a pad pivotally mounted on the distal end of each of said arms and facing outwardly for engaging oppositely facing surfaces and applying clamping forces thereto.

2. The clamping device of claim 1 further comprising:

a first pair of spaced tabs extending from the proximal end of one of said arms and having aligned holes therethrough;

a second pair of spaced apart tabs extending from the proximal end of the other of said arms and having aligned holes therethrough; and wherein said first pair of tabs is fitted between said second pair of tabs with an arm pin inserted through the holes in each of said tabs thereby pivotally securing each of said arms together at their proximal ends.

3. The clamping device of claim 2 wherein said coil spring is fitted between said second pair of tabs secured by said arm pin inserting through the center of said spring and further comprising a pair of extensions from said spring for engaging the inner surfaces of said arms and urging said arms to pivot outward.

4. The clamping device of claim 3 further comprising a pair of sidewalls along the inner surfaces of each arm which define longitudinal slots into which are inserted said spring extensions.

5. The clamping device of claim 4 wherein said pads are pivotally mounted to said arms by tabs with holes therethrough for inserting pad pins through matching holes in said arm sidewalls.

* * * * *